US010962911B2

(12) United States Patent
Seshita

(10) Patent No.: US 10,962,911 B2
(45) Date of Patent: Mar. 30, 2021

(54) FIXING DEVICE AND IMAGE FORMING APPARATUS

(71) Applicant: Takuya Seshita, Kanagawa (JP)

(72) Inventor: Takuya Seshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/800,417

(22) Filed: Feb. 25, 2020

(65) Prior Publication Data

US 2020/0272080 A1 Aug. 27, 2020

(30) Foreign Application Priority Data

Feb. 26, 2019 (JP) ..... JP2019-033014

(51) Int. Cl.
*G03G 15/20* (2006.01)

(52) U.S. Cl.
CPC ..... *G03G 15/2053* (2013.01); *G03G 15/2007* (2013.01); *G03G 15/2064* (2013.01)

(58) Field of Classification Search
CPC ..... G03G 15/2053; G03G 15/2007; G03G 15/2064
See application file for complete search history.

(56) References Cited

U.S. PATENT DOCUMENTS

2009/0014942 A1* 1/2009 Okuno ..... G03G 15/2053 271/4.06
2010/0202809 A1* 8/2010 Shinshi ..... G03G 15/2064 399/329
2013/0170880 A1* 7/2013 Gotoh ..... G03G 15/2053 399/329
2015/0261155 A1* 9/2015 Yoshiura ..... G03G 15/2053 399/329
2016/0132001 A1* 5/2016 Yamagishi ..... G03G 15/206 399/329
2016/0274515 A1* 9/2016 Imada ..... G03G 15/2053
2017/0285539 A1* 10/2017 Uchida ..... G03G 15/2057
2018/0059597 A1* 3/2018 Yamagishi ..... G03G 15/2053

* cited by examiner

*Primary Examiner* — Francis C Gray
(74) *Attorney, Agent, or Firm* — Oblon, McClelland, Maier & Neustadt, L.L.P.

(57) ABSTRACT

A fixing device is provided that includes a rotatable endless fixing member; a heat source for heating the fixing member; a pressure member that forms a nip with the fixing member; and a nip forming portion that faces the pressure member inside the fixing member and forms the nip; wherein the nip forming portion has a base material and a heat equalizing member, the heat equalizing member has a flat portion between the base material and the pressure member and a bent portion that begins to bend away from the pressure member at an upstream side edge of the base material with respect to a conveyance direction of a recording medium that is configured to be conveyed between the pressure member and the fixing member, and then the bent portion further bends to at least partially hook over a convex part of the base material that is formed at the upstream side of the base material such that an end portion of the bent portion is farther downstream with respect to the conveyance direction of a recording medium than the upstream side edge of the base material.

8 Claims, 10 Drawing Sheets

FIXING DEVICE AND IMAGE FORMING APPARATUS

CROSS-REFERENCE TO RELATED APPLICATIONS

This application is based on and claims priority pursuant to 35 U.S.C. § 119(a) to Japanese Patent Application No. 2019-033014, filed on Feb. 26, 2019, in the Japan Patent Office, the entire disclosure of which is incorporated herein by reference.

BACKGROUND

Technical Field

Embodiments of the present disclosure generally relate to a fixing device, an image forming apparatus, and a slide member, and more particularly, to a fixing device for fixing a toner image on a recording medium, an image forming apparatus for forming an image on a recording medium, and a slide member for sliding a fixing rotator that fixes an image on a recording medium.

Related Art

Various types of electrophotographic image forming apparatuses are known, including copiers, printers, facsimile machines, and multifunction machines configured to perform two or more of copying, printing, scanning, facsimile, and plotting. Such image forming apparatuses usually form an image on a recording medium according to image data. Specifically, in such image forming apparatuses, for example, a charger uniformly charges a surface of a photoconductor as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium carrying the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

Such a fixing device can further include a slide member applied with lubricant to smoothly slide, e.g., a fixing belt as a fixing rotator.

SUMMARY

In an embodiment, a fixing device is provided that includes: a rotatable endless fixing member; a heat source for heating the fixing member; a pressure member that forms a nip with the fixing member; and a nip forming portion that faces the pressure member inside the fixing member and forms the nip; wherein the nip forming portion has a base material and a heat equalizing member, the heat equalizing member has a flat portion between the base material and the pressure member and a bent portion that begins to bend away from the pressure member at an upstream side edge of the base material with respect to a conveyance direction of a recording medium that is configured to be conveyed between the pressure member and the fixing member, and then the bent portion further bends to at least partially hook over a convex part of the base material that is formed at the upstream side of the base material such that an end portion of the bent portion is farther downstream with respect to the conveyance direction of a recording medium than the upstream side edge of the base material.

In an embodiment, the base material further includes a concave portion into which the end portion of the heat equalizing member is inserted.

In an embodiment, a length of protrusion of the convex part protruding to an opposite side of the nip is greater than a sum of a length of a gap between the base material on a nip side where the nip is formed and the heat equalizing member and a length of a gap between the convex portion facing the nip and the heat equalizing member, and a width of the convex part is greater than a sum of a length of a gap between a surface of the convex portion on the upstream side in the conveyance direction and the heat equalizing member and a length of a gap between a surface of the convex portion on the downstream side in the conveyance direction of the recording medium and the heat equalizing member.

In an embodiment, the base material has one or more protrusion shapes on a surface opposite to the nip, the recess is provided on the upstream side in the conveyance direction from the protrusion shape.

In an embodiment, the bent portion includes at least a curved portion.

In an embodiment, the bent portion includes a plurality of segments which are bent relative to each other, each segment being bent substantially at a right angle with respect to a previous segment.

In an embodiment, the bent portion includes a plurality of segments which are bent relative to each other, where at least one segment forms an acute angle with respect to a previous segment.

In an embodiment, a downstream end of the flat portion of the heat equalizing member is a termination point of the heat equalizing member such that a downstream side of the base material is not covered by the heat equalizing member.

In an embodiment, the convex part of the base material is formed intermittently in a direction of the base material that is parallel to an axis of the of the pressure member.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

DETAILED DESCRIPTION

Figure 1:
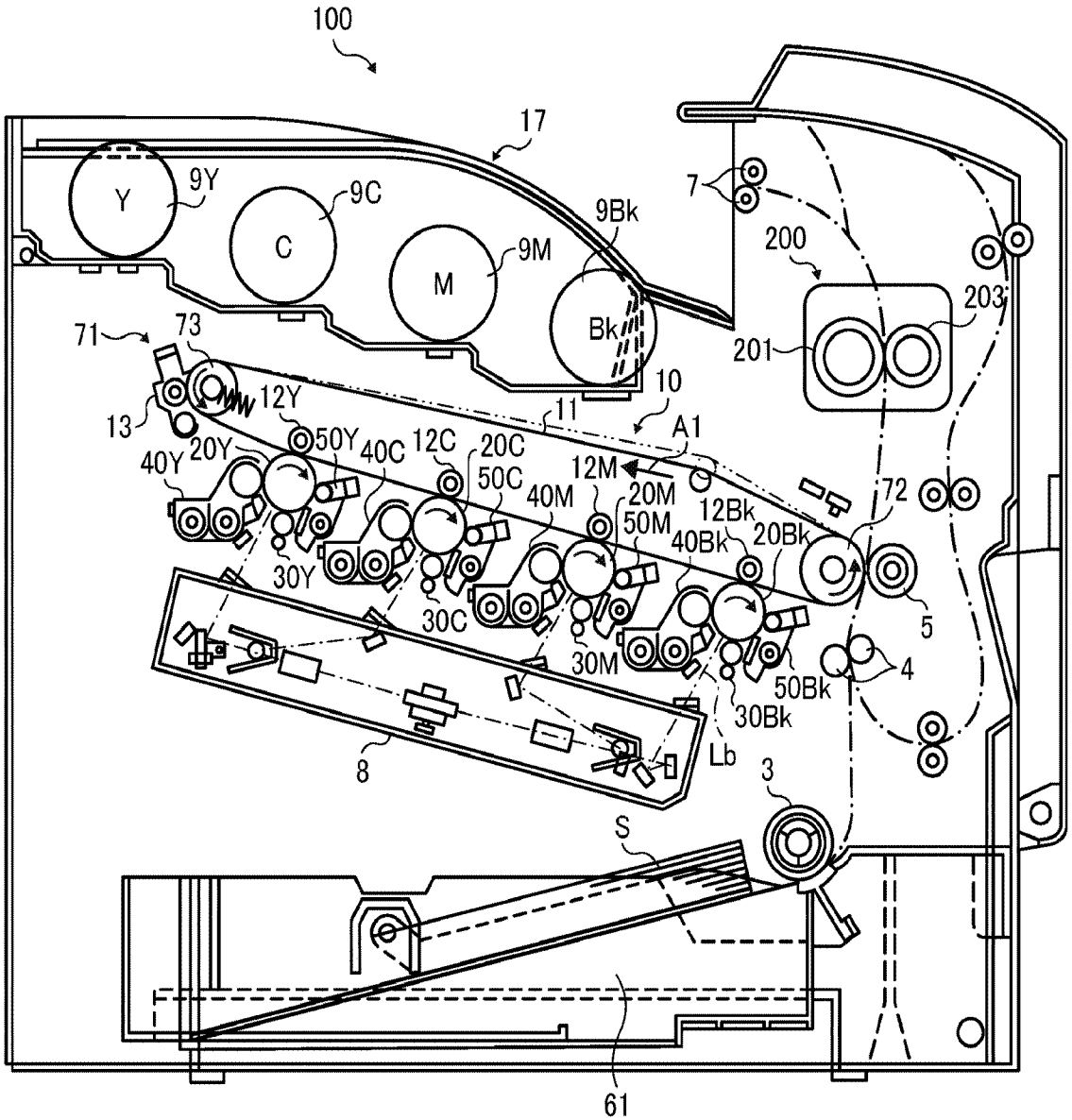
FIG. 1 is a schematic configuration diagram of an entire image forming apparatus according to one embodiment.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of the present disclosure are not necessarily indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and Bk denote colors yellow, cyan, magenta, and black, respectively. To simplify the description, these suffixes can be omitted unless necessary.

Referring now to the drawings, wherein like reference numerals designate identical or corresponding parts throughout the several views, embodiments of the present disclosure are described below.

Initially with reference to FIG. 1, a description is given of an image forming apparatus 1 according to an embodiment of the present disclosure.

FIG. 1 is a schematic view of the image forming apparatus 1.

The image forming apparatus 1 is, for example, a color printer that forms color and monochrome toner images on recording media by electrophotography.

As illustrated in FIG. 1, the image forming apparatus 1 includes a housing 2, an optical writing device 3, a process unit 4 as an image forming device, a transfer device 5, a belt cleaning device 6, a sheet feeding device 7, a sheet ejection unit 8, a registration roller pair 9, and a fixing device 10.

The image forming apparatus 1 has a tandem configuration, in which photoconductive drums 4*d* are arranged side by side, as image bearers to respectively bear toner images of yellow (Y), cyan (C), magenta (M), and black (Bk). It is to be noted that the image forming apparatus according to one embodiment of the present disclosure is not limited to such a tandem image forming apparatus, but can have another configuration. Additionally, the image forming apparatus according to one embodiment of the present disclosure is not limited to the color image forming apparatus 1, but can be another type of image forming apparatus. For example, the image forming apparatus can be a copier, a facsimile machine, or a multifunction peripheral having one or more capabilities of such devices.

The housing 2 accommodates various components. Also, inside the housing 2 is a conveyance passage R, defined by internal components of the image forming apparatus 1, along which a sheet S as a recording medium is conveyed from the sheet feeding device 7 to the sheet ejection unit 8.

The housing 2 also accommodates, e.g., toner bottles 2*a*Y, 2*a*C, 2*a*M, and 2*a*Bk below the sheet ejection unit 8. The removable toner bottles 2*a*Y, 2*a*C, 2*a*M, and 2*a*Bk contain fresh toner of the colors yellow, cyan, magenta, and black, respectively, and are mounted in the housing 2. The housing 2 also accommodates a waste toner container having an inlet in communication with a toner conveyance tube. The waste toner container receives waste toner conveyed through the toner conveyance tube.

The optical writing device 3 includes a semiconductor laser as a light source, a coupling lens, an f-θ lens, a toroidal lens, a deflection mirror, and a polygon mirror. The optical writing device 3 emits laser beams Lb onto the respective photoconductive drums 4*d* included in the process unit 4, according to yellow, cyan, magenta, and black image data, to form electrostatic latent images on the respective photoconductive drums 4*d*. The yellow, cyan, magenta, and black image data are single-color data, into which a desired full-color image data is decomposed.

The process unit 4 is constituted of four sub-process units 4Y, 4C, 4M, and 4Bk to respectively form toner images of yellow, cyan, magenta, and black. For example, the sub-process unit 4Y includes the photoconductive drum 4*d*. The sub-process unit 4Y also includes a charging roller 4*r*, a developing device 4*g*, and a cleaning blade 4*b* surrounding the photoconductive drum 4*d*. In the sub-process unit 4Y, charging, optical writing, developing, transfer, cleaning, and discharging processes are performed on the photoconductive drum 4*d* in this order.

Specifically, at first, the charging roller 4*r* charges an outer circumferential surface of the photoconductive drum 4*d* electrostatically. The optical writing device 3 conducts optical writing on the charged outer circumferential surface of the photoconductive drum 4*d*, forming an electrostatic latent image constituted of electrostatic patterns on the photoconductive drum 4*d*. Then, the developing device 4*g* adheres yellow toner supplied from the toner bottle 2*a*Y to the electrostatic latent image formed on the photoconductive drum 4*d*, thereby developing the electrostatic latent image with the yellow toner into a visible yellow toner image. The yellow toner image is primarily transferred onto the transfer device 5. Thereafter, the cleaning blade 4*b* removes residual toner that failed to be transferred onto the transfer device 5 and therefore is remaining on the photoconductive drum 4*d*, from the photoconductive drum 4*d*, rendering the photoconductive drum 4*d* to be ready for a next primary transfer. Finally, the discharging process is performed to remove residual static electricity from the photoconductive drum 4*d*.

The photoconductive drum 4*d* is a tube including a surface photoconductive layer made of organic and inorganic photoconductors. The charging roller 4*r* is disposed in proximity to the photoconductive drum 4*d* to charge the photoconductive drum 4*d* with discharge between the charging roller 4*r* and the photoconductive drum 4*d*.

The developing device 4*g* includes a supply section for supplying yellow toner to the photoconductive drum 4*d* and a developing section for adhering yellow toner to the photoconductive drum 4*d*. The cleaning blade 4*b* includes an elastic band made of, e.g., rubber, and a toner remover such as a brush. The removable developing device 4*g* is mounted in the housing 2.

Each of the sub-process units 4C, 4M, and 4Bk has a configuration equivalent to the configuration of the sub-process unit 4Y described above. Specifically, the sub-process units 4C, 4M, and 4Bk form toner images of cyan, magenta, and black to be primarily transferred onto the transfer device 5, respectively.

The transfer device 5 includes a transfer belt 5*a*, a driving roller 5*b*, a driven roller 5*c*, four primary transfer rollers 5*d*, and a secondary transfer roller 5*e*. The transfer belt 5*a* is an endless belt entrained around the driving roller 5*b* and the driven roller 5*c*. As the driving roller 5*b* and the driven roller 5*c* rotates, the transfer belt 5*a* rotates, or moves in cycles, in a rotational direction A1.

The four primary transfer rollers 5*d* are primary transfer rollers 5*d*Y, 5*d*C, 5*d*M, and 5*d*Bk pressed against the photoconductive drums 4*d* of the sub-process units 4Y, 4C, 4M, and 4Bk via the transfer belt 5*a*, respectively. Thus, the transfer belt 5*a* contacts the sub-process units 4Y, 4C, 4M, and 4Bk, forming four areas of contact, herein called primary transfer nips, between the transfer belt 5*a* and the sub-process units 4Y, 4C, 4M, and 4Bk, respectively. The secondary transfer roller 5*e* presses an outer circumferential surface of the transfer belt 5*a*, thereby pressing against the driving roller 5*b* via the transfer belt 5*a*. Thus, an area of contact, herein called a secondary transfer nip, is formed between the secondary transfer roller 5*e* and the transfer belt 5*a*.

The belt cleaning device 6 is disposed between the secondary transfer nip and the sub-process unit 4Y in the rotational direction A1 of the transfer belt 5*a*. The belt cleaning device 6 includes a toner remover and the toner conveyance tube. The toner remover removes residual toner that failed to be transferred onto the sheet S at the secondary transfer nip and therefore remains on the outer circumferential surface of the transfer belt 5*a*, from the transfer belt 5*a*. The residual toner thus removed is conveyed as waste toner through the toner conveyance tube to the waste toner container.

The sheet feeding device 7 is disposed in a lower portion of the housing 2. The sheet feeding device 7 includes a sheet tray 7*a* and a sheet feeding roller 7*b*. The sheet tray 7*a* holds a plurality of sheets S. The sheet feeding roller 7*b* picks up an uppermost sheet S from the plurality of sheets S on the sheet tray 7*a*, and feeds the uppermost sheet S to the conveyance passage R.

The sheet ejection unit 8 is disposed above the optical writing device 3 and atop the housing 2. The sheet ejection unit 8 includes a sheet ejection tray 8*a* and a sheet ejection roller pair 8*b*. The sheet ejection roller pair 8*b* ejects a sheet S bearing an image onto the sheet ejection tray 8*a*. Thus, the sheets S ejected from the conveyance passage R by the sheet ejection roller pair 8*b* rest one atop another on the sheet ejection tray 8*a*.

The registration roller pair 9 adjusts conveyance of the sheet S along the conveyance passage R, after the sheet S is fed by the sheet feeding roller 7*b* of the sheet feeding device 7.

For example, a registration sensor is interposed between the sheet feeding roller 7*b* and the registration roller pair 9 on the conveyance passage R inside the housing 2 to detect a leading edge of the sheet S conveyed along the conveyance passage R. When a predetermined time elapses after the registration sensor detects the leading edge of the sheet S, the registration roller pair 9 interrupts rotation to temporarily halt the sheet S that comes into contact with the registration roller pair 9. The registration roller pair 9 is timed to resume rotation while sandwiching the sheet S to convey the sheet S to the secondary transfer nip. For example, the registration roller pair 9 resumes rotation in synchronization with a composite color toner image, constituted of the toner images of yellow, cyan, magenta, and black superimposed one atop another on the transfer belt 5*a*, reaching the secondary transfer nip as the transfer belt 5*a* rotates in the rotation direction A1.

After the composite color toner image is transferred from the transfer belt 5*a* to the sheet S at the secondary transfer nip, the sheet S is conveyed to the fixing device 10. The fixing device 10 includes, e.g., a rotatable fixing belt 201 and a pressure roller 203 pressing against an outer circumferential surface of the fixing belt 201. The toner image is fixed onto the sheet S under heat and pressure while the sheet S is conveyed through an area of contact, herein called a fixing nip N, between the fixing belt 201 and the pressure roller 203. As the sheet S bearing the fixed toner image is discharged from the fixing nip N, the sheet S separates from the fixing belt 201 and is conveyed to the sheet ejection roller pair 8*b* along the conveyance passage R.

Figure 2:
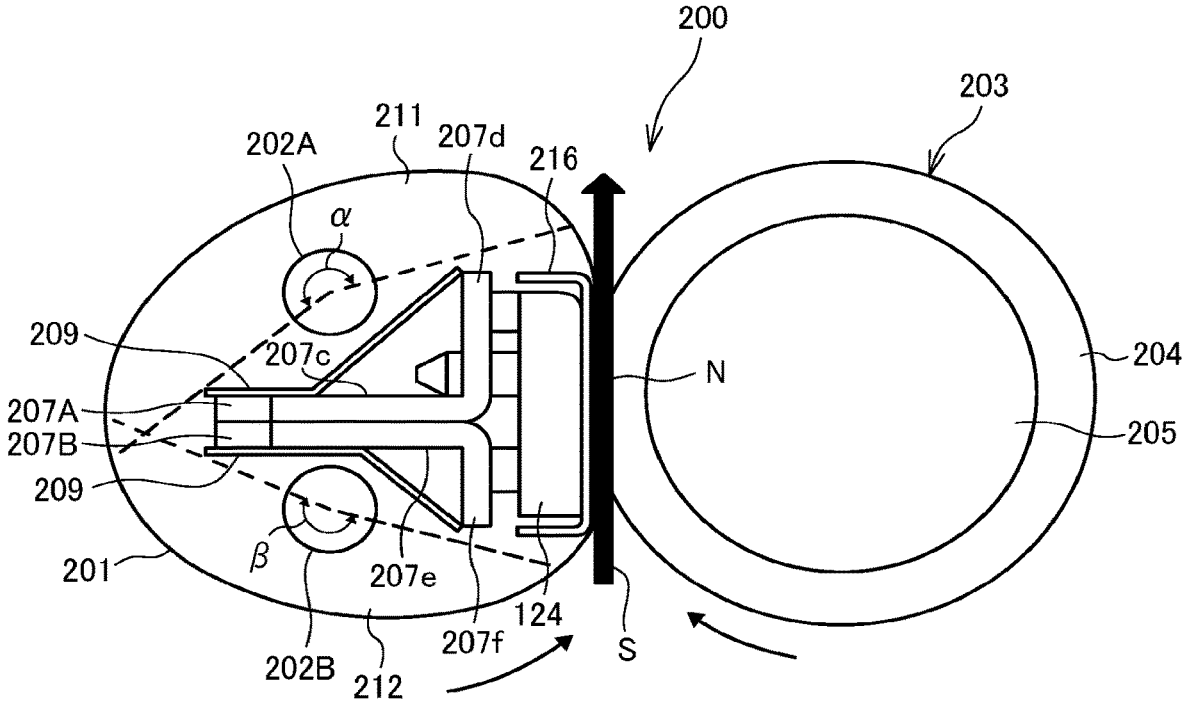
FIG. 2 is a schematic configuration view of a fixing device.

Next, a configuration example of the fixing device 200 will be described. FIG. 2 is a schematic configuration diagram illustrating a fixing device according to an embodiment. The fixing device 10 includes a fixing belt 201 as a rotatable fixing member, and a pressure roller 203 as a pressure member that is disposed to face the fixing belt 201 and is rotatable. The fixing belt 10 is heated by halogen heaters 202A and 202B as heat sources. 201 is directly heated by radiant heat from the inner peripheral side (this figure shows a plurality of heaters, but a single heater may be used).

At this time, in the fixing belt 201 of FIG. 2, there is a nip forming member 124 that forms a nip portion (also referred to as "nip") with the pressure roller 203 via the fixing belt 201. The nip forming member 124 is configured to slide indirectly with the inner surface of the fixing belt via the heat equalizing member 216. The toner image on the recording material S is fixed by heating and pressing at the nip portion.

In FIG. 2, the shape of the heat equalizing member 216 is flat, but may be a concave shape or other shapes. In the case of the concave nip portion, the discharge direction of the leading end of the recording material is closer to the pressure roller, and the separation property is improved, so that jamming is suppressed. Inside the fixing belt 201, a nip forming member 124 disposed to face the pressure roller 203, a the heat equalizing member 216 that covers a surface facing the nip forming member 124 and the inner surface of the fixing belt 201, and a nip forming member 124. And a stay member (also referred to as a "stay") 207 that holds the plate against the pressure applied by the pressure roller 203.

The nip forming member 124, the heat equalizing member 216, and the stay member 207 all have lengths that extend in the axial direction of the fixing belt 201 (hereinafter, referred to as "longitudinal direction"). The heat equalizing member 216 positively moves heat in the longitudinal direction. Therefore, it is provided in order to reduce the temperature non-uniformity in the longitudinal direction due to the suppression of the temperature rise at the edge during continuous paper feeding. For this reason, the equalizing member 216 is preferably a material that can transfer heat in a short time, and is preferably a member such as copper, aluminum, or silver having high thermal conductivity. In consideration of cost, availability, thermal conductivity characteristics, and workability, it is most desirable to use copper. In this embodiment, the surface of the heat equalizing member 216 that faces the inner surface of the fixing belt 201 is a surface that directly contacts the fixing belt 201 and serves as a nip forming surface.

The fixing belt 201 is composed of a metal belt such as nickel or SUS or an endless belt or film using a resin material such as polyimide. The surface layer of the belt has a release layer such as a PFA or PTFE layer, and has a release property so that toner does not adhere. There may be an elastic layer formed of a silicone rubber layer or the like between the belt substrate and the PFA or PTFE layer. In the absence of a silicone rubber layer, the heat capacity is reduced and the fixability is improved. On the other hand, when the unfixed image is crushed and fixed, minute irregularities on the surface of the belt are transferred to the image, and there may be a problem that a crusty glossy unevenness remains in the solid portion of the image. In order to improve this, it is necessary to provide a silicone rubber layer of 100 [μm] or more. Due to the deformation of the silicone rubber layer, the problem that minute irregularities are absorbed and gloss unevenness remains is improved.

The stay member 207 has a shape having an upright portion standing upright on the opposite side to the nip portion N side. Halogen heaters 202A and 202B as fixing heat sources are arranged with the upright portion therebetween, and the fixing belt 201 is directly heated by radiant heat from the inner surface side by the halogen heaters 202A and 202B.

The stay member 207 as a support member for supporting the nip forming member 124 and the nip portion N is provided inside the fixing belt 201 to prevent the nip forming member 124 that receives pressure from the pressure roller 203 from being bent, and in the axial direction. So that a uniform nip width can be obtained. The stay member 207 is held and fixed to a flange as a holding member at both ends. Further, by providing the reflecting member 209 between the halogen heater 202 and the stay member 207, wasteful energy consumption due to the stay member 207 being heated by the radiant heat from the halogen heater 202 is suppressed. Here, instead of providing the reflecting member 209, the same effect can be obtained even if the surface of the stay member 207 is heat-insulated or mirror-finished.

The pressure roller 203 has an elastic rubber layer 204 on a metal core 205, and a release layer (PFA or PTFE layer) is provided on the surface in order to obtain releasability. The pressure roller 203 is rotated by a driving force transmitted from a driving source such as a motor provided in the image forming apparatus via a gear. The pressure roller 203 is pressed against the fixing belt 201 by a spring or the like, and has a predetermined nip width when the elastic rubber layer 204 is crushed and deformed. The pressure roller 203 may be a hollow roller, and the pressure roller 203 may have a heating source such as a halogen heater. The elastic rubber layer 204 may be solid rubber, but if there is no heater inside the pressure roller 203, sponge rubber may be used. Sponge rubber is more desirable because it increases heat insulation and makes it difficult for the fixing belt to lose heat.

The fixing belt 201 rotates along with the pressure roller 203. In the case of FIG. 2, the pressure roller 203 is rotated by a driving source, and the driving force is transmitted to the belt at the nip portion N, whereby the fixing belt 201 is rotated. The fixing belt 201 is sandwiched and rotated at the nip portion N, and travels while being guided by flanges (not shown) at both ends except the nip portion. The above configuration makes it possible to realize a fixing device that is inexpensive and has a fast warm-up.

A description will be given below of a case where the nip forming portion of one embodiment of the present invention is applied to the image forming apparatus and the fixing apparatus described above. A fixing device according to an embodiment of the present invention is rotatable and includes a fixing member that is provided with an elastic layer and a release layer on a substrate surface, a heat source that heats the fixing member, and a pressure that forms a nip with the fixing member. A nip forming part that forms a nip opposite to the pressure member inside the fixing member has the following characteristics.

The nip forming part has a base material (also referred to as "pad") and a heat equalizing member (also referred to as "heat equalizing plate").

The heat equalizing member has a bent portion that is bent toward the inner surface side of the fixing member on the upstream side in the conveyance direction of the recording medium.

The base material has a convex portion (also referred to as "protrusion" or "protrusion") that is provided on the upstream side in the conveyance direction of the recording medium and fits with the bent portion.

With these features, the heat equalizing member may hold the convex part of a base material in the conveyance direction upstream (only one side of a conveyance direction) of a nip formation part.

Figure 3:
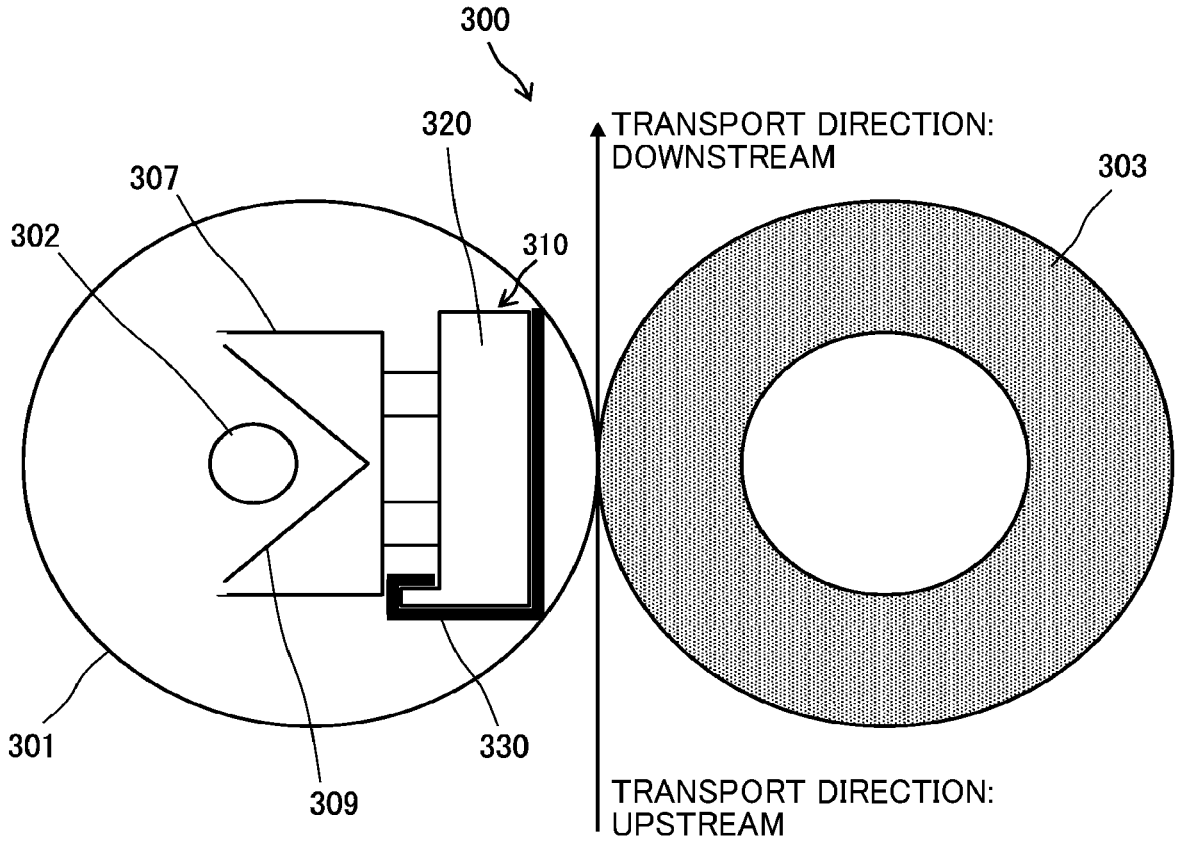
FIG. 3 is a schematic cross-sectional view illustrating a fixing device according to an embodiment.

The nip forming part of one embodiment will be described in detail with reference to the following drawings. FIG. 3 is a schematic cross-sectional view illustrating a fixing device according to an embodiment. In the following description, brackets show the correspondence with the configuration of FIG. 2. The fixing device 10 includes a fixing member 301 [fixing belt 201], a heat source 302 [halogen heaters 202A and 202B], a pressure member 303 [pressure roller 203], a stay 307 [stay member 207], and a reflector 309 [reflection member 209], a base member 320 [nip forming member 124, and a heat equalizing member 330 [heat equalizing member 216]. The base member 320 and the heat equalizing member 330 are referred to as a nip forming part 310.

The connection between the heat equalizing member 330 and the base material 320 is configured as follows. On the upstream side in the conveyance direction of the recording medium, the heat equalizing member 330 is turned to the back surface of the base material 320 (the side not in contact with the fixing member 301) and is caught by a protrusion (convex portion) provided on the base material 320. Here, the back surface of the base material 320 is a side that does not contact the fixing member 301. Further, hereinafter, the "recording medium transport direction" is also referred to as "transport direction", and the "recording medium transport direction upstream side" is also referred to as "transport direction upstream side" or "upstream side".

Figures 4A, 4B, 4C, 4D:
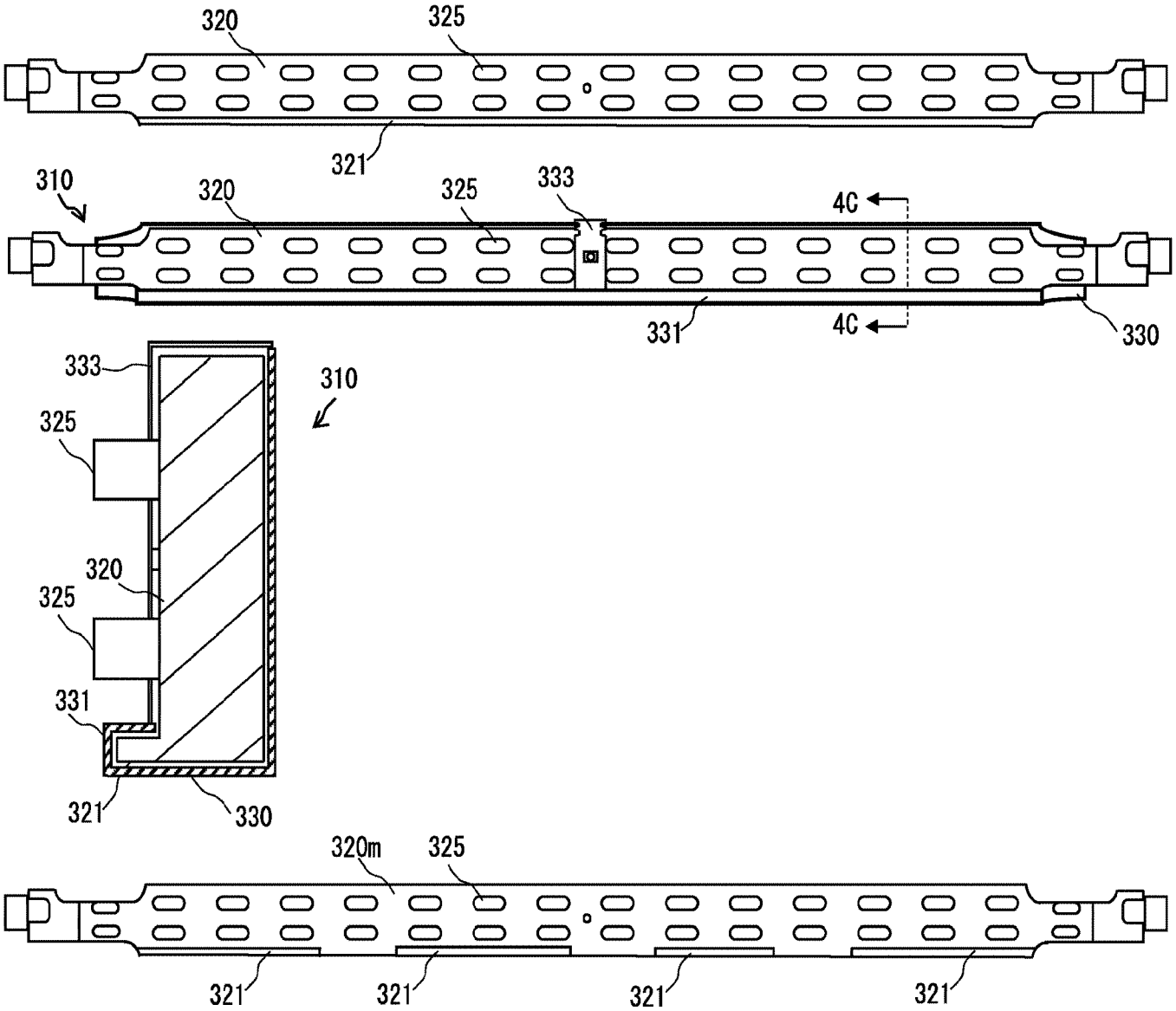
FIGS. 4A, 4B, 4C, and 4D are diagrams illustrating a nip forming unit according to an embodiment.

FIGS. 4A-4D are diagrams i illustrating a nip forming unit according to an embodiment. FIG. 4A is a diagram for explaining a base material, FIG. 4B is a diagram in which a heat equalizing member is attached to the base material, FIG. 4C is a cross-sectional view taken along line 4A-4B in FIG. 4B, FIG. 4D is a figure which shows the modification of a base material. FIG. 4A and FIG. 4B show a surface opposite to the side (the surface facing the stay 307) where the nip is formed (hereinafter referred to as "nip side"). The nip forming unit 310 includes a resin base material 320 and a heat equalizing member 330. The heat equalizing member 330 has a higher thermal conductivity than the base material 320. Then, it is disposed on the nip side of the base material 320 along the longitudinal direction of the base material 320.

Furthermore, a bent portion that is bent toward the inner peripheral side of the fixing member is provided on the upstream side in the transport direction.

The base material 320 has a convex portion 321 that is provided on the upstream side in the transport direction and fits with the bent portion 331. The base material 320 has one or more protrusion shapes 325 on the surface opposite to the nip side.

The base material 320 has a convex portion 321 that is provided on the upstream side in the transport direction and fits with the bent portion 331. The base material 320 has one or more protrusion shapes 325 on the surface opposite to the nip side. In FIG. 4, a plurality of protrusion shapes 325 are shown. As for the plurality of protrusion shapes 325, a plurality of protrusion shapes 325 arranged in the short direction of the base material 320 are arranged in the longitudinal direction so as to be separated from each other. By disposing a plurality of protrusion shapes 325 on the base material 320 and forming an uneven shape having protrusions, heat dissipation to the stay 307 side can be suppressed while enabling pressure transmission from the stay 307 side to the nip.

When fixing the heat equalizing member 330, it is slid and assembled so as to be inserted from the lateral direction (longitudinal direction) of the base material 320. By appropriately setting a gap (see FIGS. 8 and 9) between the base material 320 and the heat equalizing member 330 described later, the heat equalizing member 330 does not come off from the base material 320. In this way, the heat equalizing member 330 can be fixed to the base material 320 more easily and cheaply than the conventional fixing method. If the nip forming portion 310 is tilted or shifted in the longitudinal direction, the heat equalizing member 330 is detached, but the longitudinal direction is not tilted for assembly and there is no problem. In addition, since it is hooked on the upstream side on the downstream side in the transport direction, it is not necessary to process the heat equalizing member for holding.

The heat equalizing member 330 is preferably fixed by a fixing member 333 as shown in FIG. 4A and FIG. 4B. In the following examples, the fixing member 333 is omitted. The convex part 321 of the base material 320 of FIG. 4A may be provided intermittently like the base material 320*m* shown in FIG. 4D.

A nip forming portion provided in a conventional fixing device will be described. Conventionally, there has been a problem with the heat equalizing member fixing method. For example, if the heat equalizing member is not fixed to the base material, it may come off at the time of assembly or may come off at the time of decompression. In order to prevent this, the heat equalizing member is fixed to the base material so as not to come off.

Figure 5:
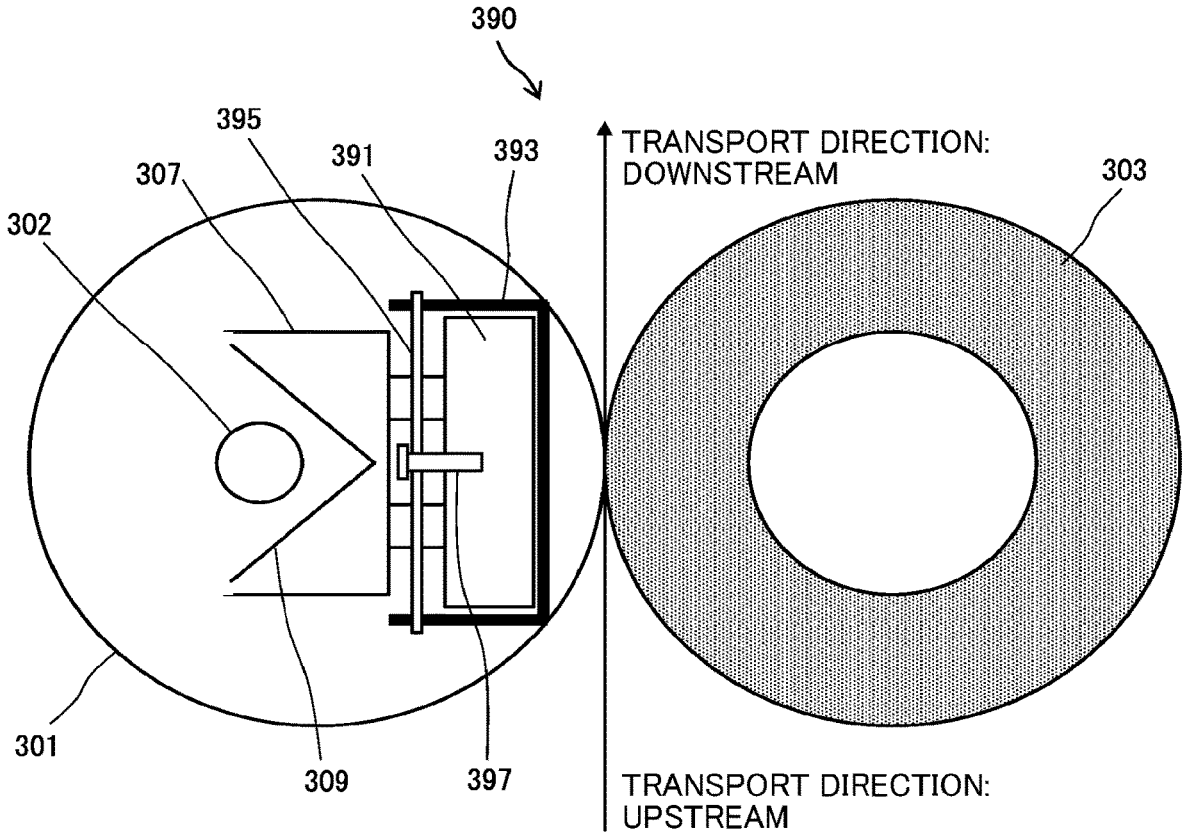
FIG. 5 is a schematic diagram for explaining a prior fixing means for a heat equalizing member.

FIG. 5 is a schematic diagram for explaining a conventional fixing means for a heat equalizing member. In the fixing device 390, when the heat equalizing member 393 is used in the nip forming portion, the heat equalizing member 393 needs to be fixed to the surface of the base material 391 when the heat equalizing member 393 is assembled to the base material 391. However, in the conventional configuration, as shown in FIG. 5, the heat equalizing member 393 is configured so as to cover the base material 391, and the heat equalizing member fixing member 395 is screwed from the back with a screw 397. For this reason, the number of parts is large and assembly takes time.

On the other hand, the nip forming unit 310 according to an embodiment is configured to be held from the back side or the lower side of the base material 320 on the upstream side in the transport direction of the heat equalizing member 330. If it does in this way, it can prevent the heat equalizing member 393 not removing, without using screwing. Thereby, the conventional problems described above can be solved.

With reference to FIG. 6, an embodiment of the nip forming portion will be described. FIG. 6 is a schematic diagram illustrating an example of the nip forming unit 310. In FIG. 6A, the nip forming portion 310*a* has a configuration in which a heat equalizing member 330*a* is bent and hooked on a convex portion 321*a* provided on the upstream side of the base material 320*a*. A bent portion 331*a* formed by bending the upstream side of the heat equalizing member 330*a* is fitted to the convex portion 321*a*, and the heat equalizing portion. The material 330*a* is fixed to the base material 320*a*. The nip forming part 310*a* is the same as the nip forming part 310 (FIG. 4) described above.

Figure 6A:
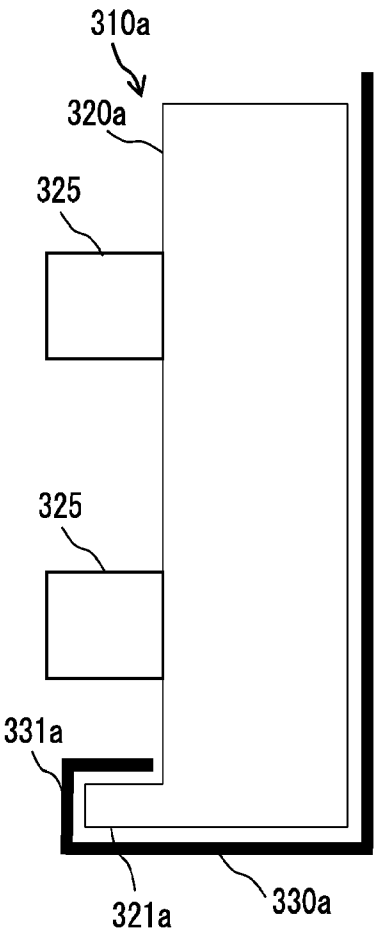
FIGS. 6A, 6B, 6C, and 6D are schematic diagrams for explaining an embodiment of the nip forming portion.

In FIG. 6A, the nip forming portion 310*a* has a configuration in which a heat equalizing member 330*a* is bent and hooked on a convex portion 321*a* provided on the upstream side of the base material 320*a*. A bent portion 331*a* formed by bending the upstream side of the heat equalizing member 330*a* is fitted to the convex portion 321*a* to fix the heat equalizing member 330*a* to the base material 320*a*. The nip forming part 310*a* is the same as the nip forming part 310 (FIG. 4) described above.

Figure 6B:
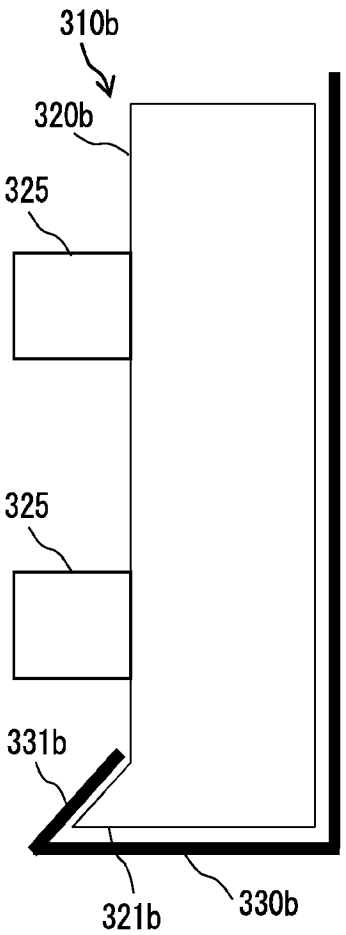

In FIG. 6B, the nip forming portion 310*b* has a configuration in which the number of times that the heat equalizing member 330*b* is bent is reduced on the convex portion 321*b* provided on the upstream side of the base material 320*b*. Since the base material 320*b* can avoid stress concentration around the convex portion 321*b*, it is difficult to break even if it is dropped during the assembly operation. Further, since the number of times of bending of the bent portion 331*b* of the heat equalizing member 330*b* is less than that of the heat equalizing member 330*a*, it is possible to produce at a lower cost.

Figure 6C:
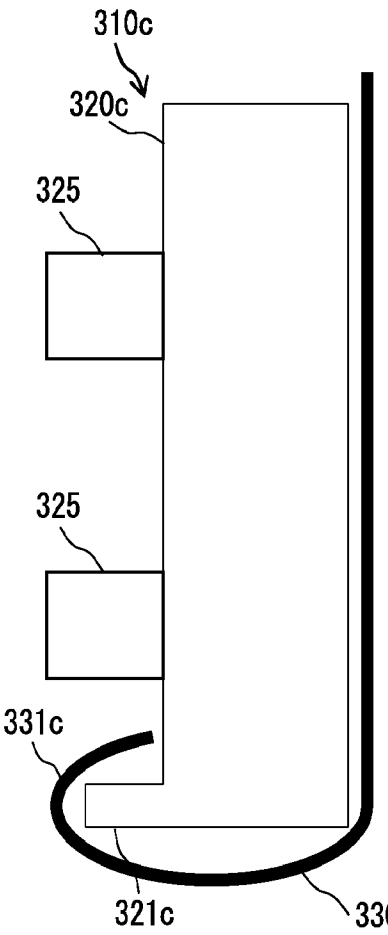

In FIG. 6C, the nip forming portion 310*c* has a configuration in which a heat equalizing member 330*c* is bent and hooked on a convex portion 321*c* provided on the upstream side of the base material 320*c*. The bent portion 331*c* of the heat equalizing member 330*c* changes the bent shape of the bent portion 331*a* (FIG. 6A). This is just an example, and the same effect can be obtained.

Figure 6D:
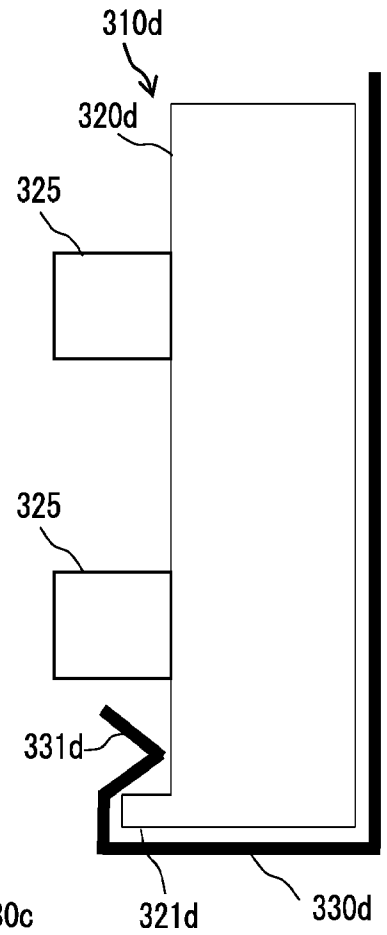

In FIG. 6D, the upstream side of the heat equalizing member 330*d* is bent. The nip forming portion 310*d* is stopped by the shape (snap fit) of the bent portion 331*d* of the heat equalizing member 330*d* on the convex portion 321*d* provided on the upstream side of the base member 320*d*. The nip forming part 310*d* cannot be detached when the convex part 321*d* is caught by the patch formed as the bent part 331*d*. Here, the "snap fit" means that, for example, a part of the member is bent to form a mountain shape, and the other member is fixed to the two parts by fitting the portion of the mountain shape.

In the nip forming portions 310*a* to 310*c* described with reference to FIG. 6, the nip forming portion 310 slides from the side when the heat equalizing member 330 is assembled to the substrate 320. On the other hand, the nip forming portion 310*d* can be inserted by snap fit even from above in the vertical direction.

Further, the upstream shape of the base material 320 and the upstream shape of the heat equalizing member 330 are desirably the same shape as shown in FIGS. 6(A), (B), and (D).

FIG. 7 is a schematic diagram for explaining another embodiment of the nip forming portion. 7A to 7D, concave portions 322*e* to 322*h* are provided on the upstream side of the base materials 320*e* to 320*h*, and the bent portions 331*e* to 331*h* of the heat equalizing members 330*e* to 330*h* are fitted into the concave portions 322*e* to 322*h*. In the following description, when the embodiments of FIGS. 6 and 7 are not distinguished, alphabetic identifiers such as the base material 320, the convex portion 321, the concave portion 322, the heat equalizing member 330, and the bent portion 331 are omitted.

The recess 322 is formed so that the end of the heat equalizing member 330 on the upstream side in the transport direction can be inserted into the interior. The concave portion 322 functions as a slit provided in the base member 320, so that a part of the heat equalizing member 330 is inserted into the concave portion 322, and the base member 320 holds the heat uniform member 330. In this way, the heat equalizing member 330 can be fixed to the base material 320.

In FIG. 7, the base material 320 is provided with a convex part 321 (protrusion part) on the upstream side of the concave part 322 by forming the concave part 322. As a result, the bent portion 331 formed by bending the upstream side of the heat equalizing member 330 is inserted into the recessed portion 322, so that the protruding portion 321 and the recessed portion 331 are recessed. The heat equalizing member 330 is fixed to the base material 320 by being fitted to the portion 322.

The nip forming portions 310*e* to 310*h* in FIG. 7 are characterized in that no protruding portion is provided on the inner surface side of the fixing member 301 with respect to the thickness of the base material 320. As a result, the apparatus can be downsized.

Figure 7A:
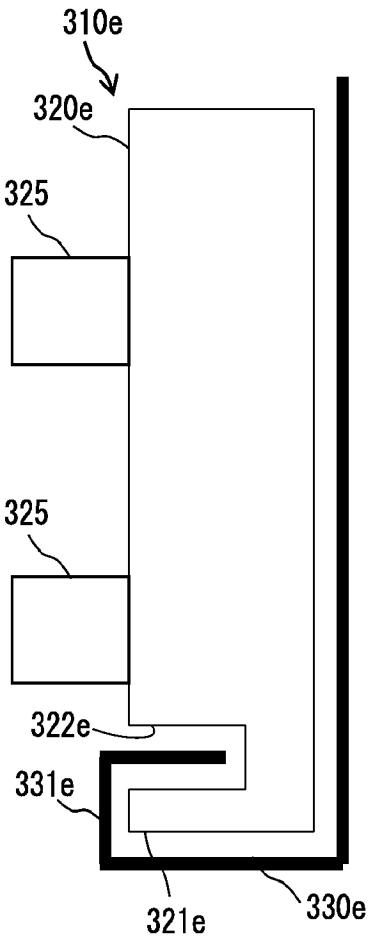
FIGS. 7A, 7B, 7C, and 7D are schematic diagrams for explaining another embodiment of the nip forming portion.
Figure 7B:
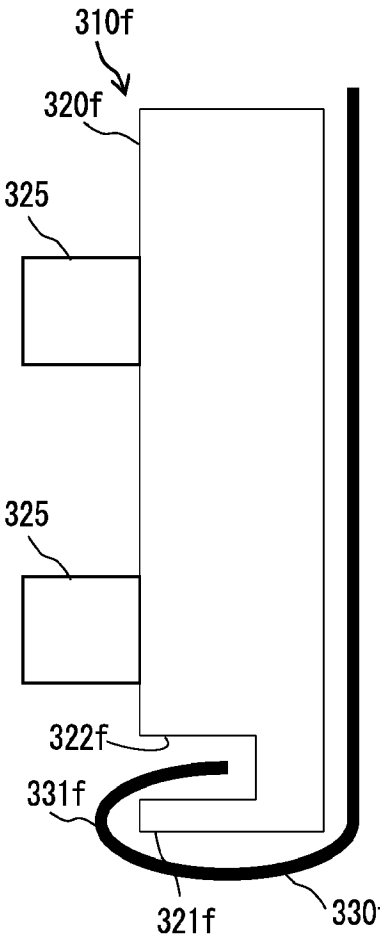
Figure 7C:
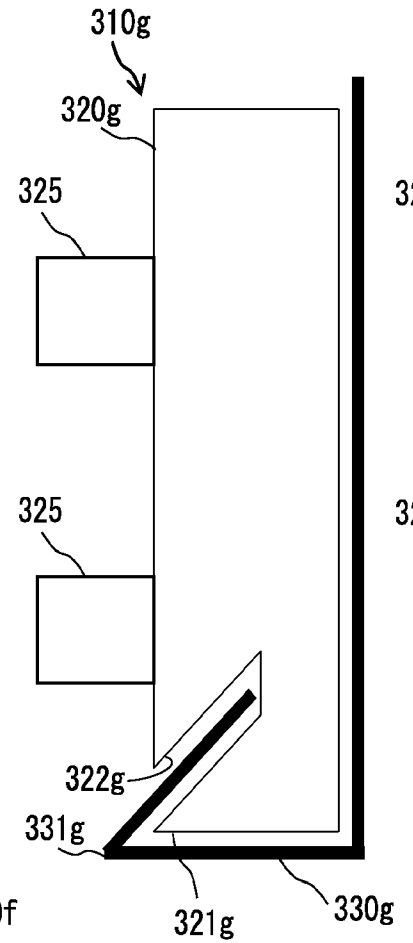
Figure 7D:
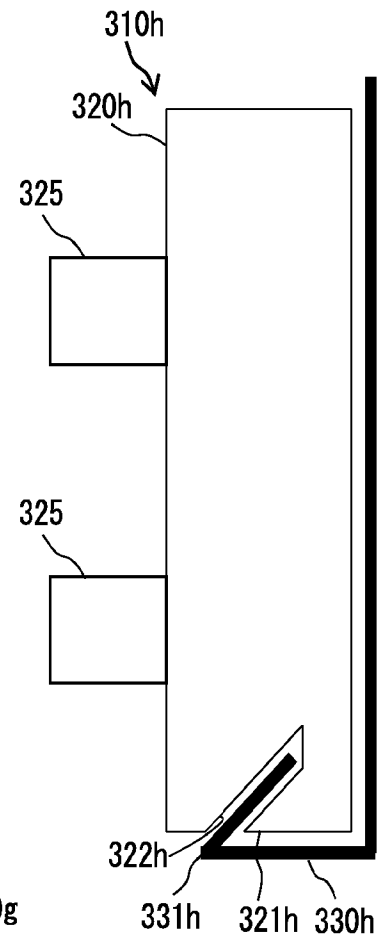

In FIG. 7A, the bent portion 331*e* is configured to be bent at a right angle, and in FIG. 7B, the bent portion 331*f* is configured with a curve. FIGS. 7C and 7D are configuration examples in which the number of bending of the bent portions 331*g* and 331*h* is reduced compared to FIGS. 7A.7C and 7D, since the number of bending of the bent portions 331*g* and 331*h* is small, it can be manufactured at a lower cost. Also in these configurations, it is desirable that the upstream shape of the base member 320 and the heat equalizing member 330 be the same.

Figure 8B:
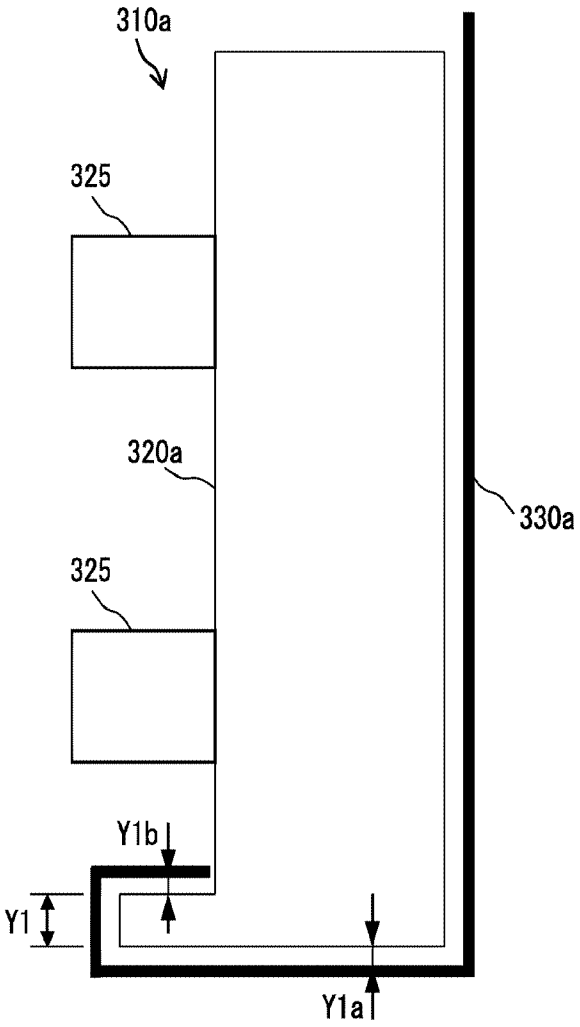
FIGS. 8A and 8B are schematic diagrams for explaining the size between the base material and the heat equalizing member of the nip forming portion in FIG. 6.
Figure 8A:
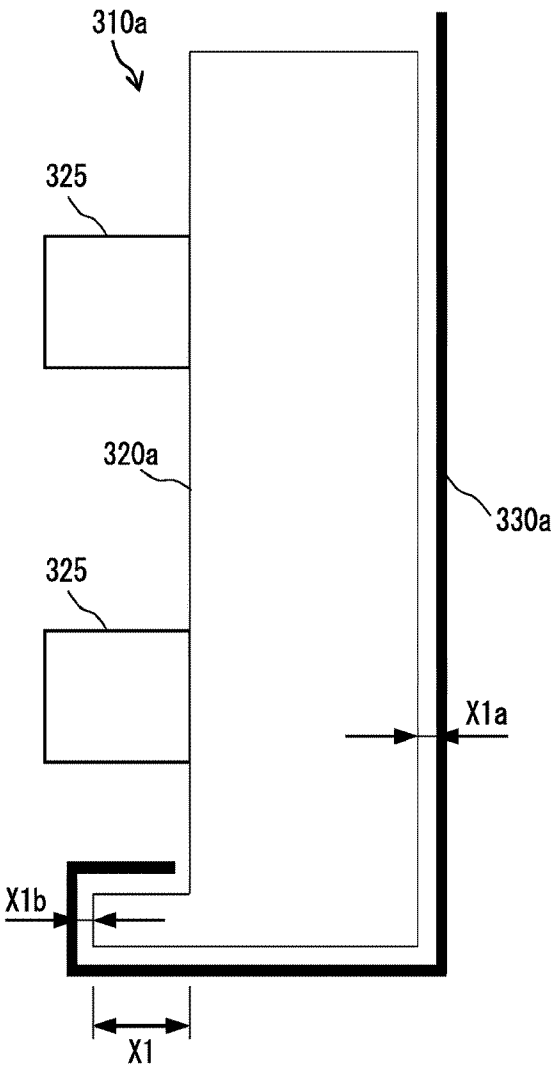

Next, it will be described that it is preferable to manage the gap (distance) between the base material 320 and the heat equalizing member 330 when using the configuration of the nip forming portion 310 of one embodiment. FIG. 8 is a schematic diagram for explaining the size between the base material of the nip forming portion and the heat equalizing member. FIG. 8A is a figure explaining amount X1, FIG. 8B is a figure explaining amount Y1. FIG. 8 will be described using the shape of the nip forming portion 310*a* shown in FIG. The same applies to c and 310*d*.

Next, it will be described that it is preferable to manage the gap (distance) between the base material 320 and the heat equalizing member 330 when using the configuration of the nip forming portion 310 of one embodiment. FIG. 8 is a schematic diagram for explaining the size between the base material of the nip forming portion and the heat equalizing member. FIG. 8A is a diagram for explaining the applied amount X1, and FIG. 8B is a diagram for explaining the applied amount Y1. FIG. 8 will be described using the shape of the nip forming portion 310*a* shown in FIG. 6A, but the same applies to the nip forming portions 310*c* and 310*d*.

Specifically, as shown in FIGS. 8A and 8B, the amount of engagement X1 corresponding to the convex portion 321*a* is set as follows. That is, the hook amount X1 is larger than the sum of the gap X1*a* and the gap X1*b*, and the hook amount Y1 is larger than the sum of the gap Y1*a* and the gap Y1*b*.

Figure 9B:
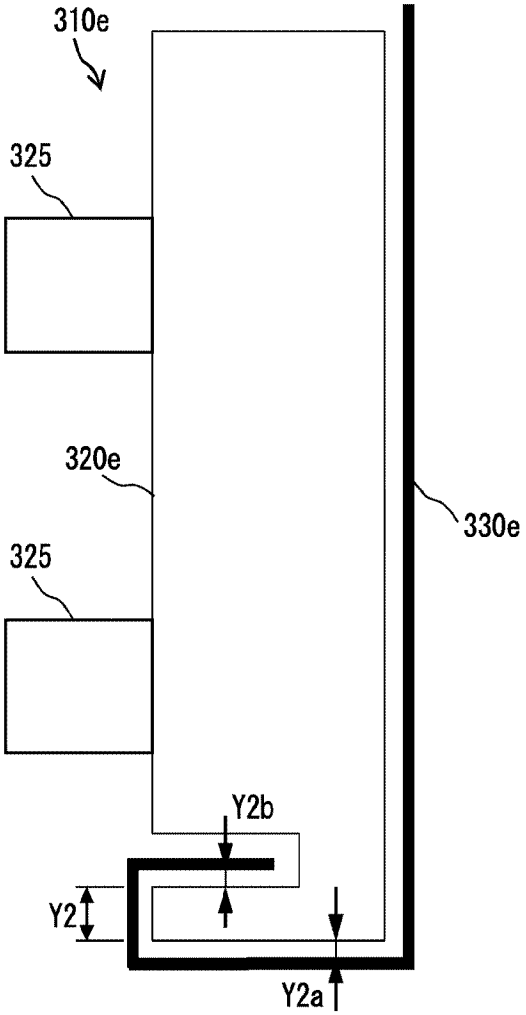
FIGS. 9A and 9B are schematic diagrams for explaining the size between the base material and the heat equalizing member of the nip forming portion in FIG. 7.
Figure 9A:
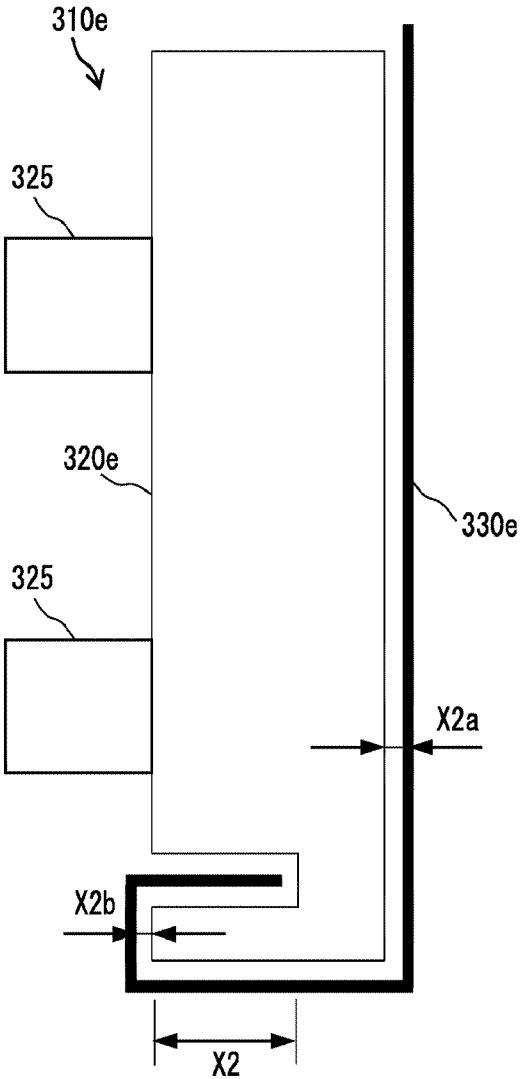

FIG. 9 is a schematic diagram for explaining the size between the base material and the heat equalizing member of the nip forming portion provided with the recesses. FIG. 9A is a diagram for explaining the applied amount X2, and FIG. 9B is a diagram for explaining the applied amount Y2. FIG. 9A and FIG. 9B are described using the shape of the nip forming portion 310*e* shown in FIG. 7A however same applies to the forming portion 310*f*.

As shown in FIGS. 9A and 9B, in the case of the configuration in which the concave portion 322*e* is provided in the base material 320*e*, the amount of engagement X2 corresponding to the concave portion 322*e* is larger than the sum of the gap X2*a* and the gap X2*b*. And the amount of hook Y2 is more than the sum of gap Y2*a* and gap Y2*b* Enlarge. If this regulation is not met, the base material 320*e* cannot hold the heat equalizing member 330*e*.

Further, the amount of application can be explained as follows.

As described with reference to FIGS. 8 and 9, the amount of hooking is the size (length) by which the bent portion 331 is hung (hanged) on the convex portion 321. The amount of protrusion on the projection is referred to as the amounts X1 and X2 (also referred to as "first amount") and the amounts Y1 and Y2 (also referred to as "second amount").

The hooking amounts X1 and X2 are the lengths (the height of the protrusions) at which the protrusions 321 protrude on the opposite side of the nip. The hanging amounts Y1 and Y2 are the width (thickness) of the convex portion 321. The amount of protrusion of the convex portion 321 satisfies the following (1) and (2). (1) The amount of engagement X1 and X2 includes the length of the gap (gap X1*a*, X2*a*) between the base member 320 on the nip side where the nip is formed and the heat equalizing member 330, and the portion of the convex portion 321 facing the nip. It is larger than the sum of the lengths of the gaps with the heat equalizing member 330 (gap X1*b*, X2*b*). (2) The hanging amounts Y1 and Y2 are the lengths of the gaps (gap Y1*a*, Y2*a*) between the surface of the convex portion 321 on the upstream side in the transport direction and the heat equalizing member 330, and the convex portion 321 on the downstream side in the transport direction of the recording medium. It is greater than the sum of the lengths of the gaps between the surface and the heat equalizing member 330 (gap Y1*b*, Y2*b*).

The gap is defined as the length of the gap (gap size, gap distance) between the base material 320 (or the convex portion 321 of the base material 320) and the heat equalizing member 330. Regarding the gaps X1*b* and X2*b*, the portion of the convex portion 321 facing the nip is the surface of the convex portion 321 (for example, FIGS. 6A, 6C, and 7D, FIGS. 7A and 7B). Moreover, when the convex part 321 is a shape of FIG. 6(B), FIG. 7(C) (D), for example, gap X1*b*, X2*b* is the convex part 321 along the protrusion direction where the convex part 321 protrudes. The length of the gap between the portion and the heat equalizing member 330 may be used.

The protruding direction is a direction intersecting with the conveyance direction of the recording medium. The width direction is, for example, a direction along the recording medium conveyance direction. The width direction may intersect with the conveyance direction of the recording medium, but the angle between the conveyance direction of the recording medium and the width direction is smaller than the angle between the conveyance direction of the recording medium and the protruding direction. The protruding direction and the width direction do not necessarily have to be perpendicular to each other. The protruding direction is preferably perpendicular to the recording medium conveyance direction. The width direction is preferably parallel to the conveyance direction of the recording medium.

Figure 10:
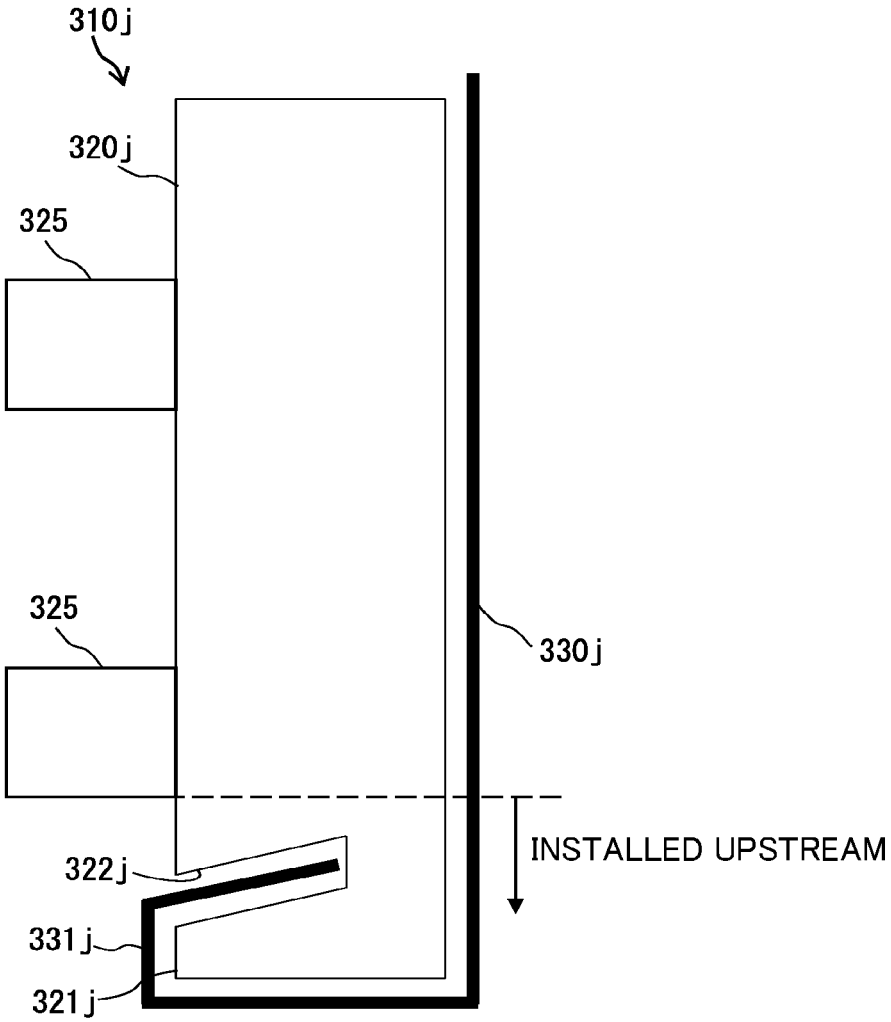
FIG. 10 is a schematic diagram for explaining a base material of a nip forming portion in which a concave portion is provided.

FIG. 10 is a schematic diagram for explaining a base material of a nip forming portion in which a recess is provided. FIG. 10 shows a nip forming portion 310*j* having a base material 320*j* and a heat equalizing member 330*j*. The base member 320*j* is provided with a concave portion 322*j* to form a convex portion 321*j*. The heat equalizing member 330*j* has a bent portion 331*j* that fits with the convex portion 321*j* and the concave portion 322*j*.

As shown in FIG. 10, when the nip forming portion 310*j* is configured to hold the heat equalizing member 330*j* by the concave portion 322*j*, the installation position of the concave portion 322*j* is the end portion (upstream side of the protrusion shape 325 provided on the base material 320). It is desirable to be provided upstream from the end portion.

FIG. 10 shows an example of the nip forming portion 310*j*, but the same applies to the shape of another concave portion 322 such as the nip forming portion shown in FIG. 8. In the case where the plurality of rows of protrusion shapes 325 are provided, the recesses 322 may be provided on the upstream side of the most upstream end portion of the plurality of rows of protrusion shapes 325.

In some cases, the upstream end of the nip width is upstream of the protrusion shape 325 of the base material 320. For example, the machine may have a large nip width, the center of the nip width may be deviated from the center of the base material 320, or the protrusion shape 325 of the base material 320 may not be equally spaced with respect to the center of the nip.

In such a case, even when the hole bottom of the recess 322 is installed on the upstream side of the protrusion shape 325 of the base material 320, stress concentration occurs due to the nip load. Therefore, in such a case, the hole bottom of the concave portion 322 is located on the upstream side of the line (on the broken line shown in FIG. 10) in which the upstream end portion of the nip width from the protrusion shape 325 is linearly connected to the base material 320. It is desirable. This prevents problems such as the pad from cracking starting from the bottom of the recess due to the stress concentration of the applied pressure.

As mentioned above, although the invention made by the present inventor has been specifically described based on the embodiments, the claimed invention is not limited to the above-described embodiments, and various modifications can be made without departing from the scope of the invention.

The invention claimed is:

1. A fixing device comprising:

a rotatable endless fixing member;

a heat source for heating the fixing member;

a pressure member that forms a nip with the fixing member; and a nip forming portion that faces the pressure member inside the fixing member and forms the nip;

wherein the nip forming portion has a base material and a heat equalizing member, the heat equalizing member has a flat portion between the base material and the pressure member and a bent portion that begins to bend away from the pressure member at an upstream side edge of the base material with respect to a conveyance direction of a recording medium that is configured to be conveyed between the pressure member and the fixing member, and then the bent portion further bends to at least partially hook over a convex part of the base material that is formed at an upstream side of the base material such that an end portion of the bent portion is farther downstream with respect to the conveyance direction of a recording medium than the upstream side edge of the base material, wherein the base material further includes a concave portion into which the end portion of the heat equalizing member is inserted.

2. A fixing device comprising:

a rotatable endless fixing member;

a heat source for heating the fixing member;

a pressure member that forms a nip with the fixing member; and a nip forming portion that faces the pressure member inside the fixing member and forms the nip;

wherein the nip forming portion has a base material and a heat equalizing member, the heat equalizing member has a flat portion between the base material and the pressure member and a bent portion that begins to bend away from the pressure member at an upstream side edge of the base material with respect to a conveyance direction of a recording medium that is configured to be conveyed between the pressure member and the fixing member, and then the bent portion further bends to at least partially hook over a convex part of the base material that is formed at an upstream side of the base material such that an end portion of the bent portion is farther downstream with respect to the conveyance direction of a recording medium than the upstream side edge of the base material, wherein a length of protrusion of the convex part protruding to an opposite side of the nip is greater than a sum of a length of a gap between the base material on a nip side where the nip is formed and the heat equalizing member and a length of a gap between the convex portion facing the nip and the heat equalizing member, and a width of the convex part is greater than a sum of a length of a gap between a surface of a convex portion on the upstream side in the conveyance direction and the heat equalizing member and a length of a gap between a surface of the convex portion on a downstream side in the conveyance direction of the recording medium and the heat equalizing member.

3. The fixing device according to claim 1, the base material has one or more protrusion shapes on a surface opposite to the nip, a recess is provided on the upstream side in the conveyance direction from the protrusion shape.

4. The fixing device according to claim 1, wherein the bent portion includes at least a curved portion.

5. The fixing device according to claim 1, wherein the bent portion includes a plurality of segments which are bent relative to each other, each segment being bent substantially at a right angle with respect to a previous segment.

6. The fixing device according to claim 1, wherein the bent portion includes a plurality of segments which are bent relative to each other, where at least one segment forms an acute angle with respect to a previous segment.

7. The fixing device according to claim 1, wherein a downstream end of the flat portion of the heat equalizing member is a termination point of the heat equalizing member such that a downstream side of the base material is not covered by the heat equalizing member.

8. A fixing device comprising:

a rotatable endless fixing member;

a heat source for heating the fixing member;

a pressure member that forms a nip with the fixing member; and a nip forming portion that faces the pressure member inside the fixing member and forms the nip;

wherein the nip forming portion has a base material and a heat equalizing member, the heat equalizing member has a flat portion between the base material and the pressure member and a bent portion that begins to bend away from the pressure member at an upstream side edge of the base material with respect to a conveyance direction of a recording medium that is configured to be conveyed between the pressure member and the fixing member, and then the bent portion further bends to at least partially hook over a convex part of the base material that is formed at an upstream side of the base material such that an end portion of the bent portion is farther downstream with respect to the conveyance direction of a recording medium than the upstream side edge of the base material, wherein the convex part of the base material is formed intermittently in a direction of the base material that is parallel to an axis of the of the pressure member.

* * * * *